US009914304B2

(12) United States Patent
Shirotori et al.

(10) Patent No.: US 9,914,304 B2
(45) Date of Patent: Mar. 13, 2018

(54) RECORDING APPARATUS

(71) Applicant: SEIKO EPSON CORPORATION, Tokyo (JP)

(72) Inventors: Hiroshi Shirotori, Azumino (JP); Tadahiro Mizutani, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/234,496

(22) Filed: Aug. 11, 2016

(65) Prior Publication Data

US 2017/0057237 A1 Mar. 2, 2017

(30) Foreign Application Priority Data

Aug. 31, 2015 (JP) ..... 2015-170167

(51) Int. Cl.

| | |
|---|---|
| ***B41J 2/175*** | (2006.01) |
| ***B41J 29/02*** | (2006.01) |
| ***B41J 29/13*** | (2006.01) |
| ***B41J 29/393*** | (2006.01) |

(52) U.S. Cl.

CPC ..... *B41J 2/17503* (2013.01); *B41J 2/1752* (2013.01); *B41J 2/1753* (2013.01); *B41J 2/17513* (2013.01); *B41J 2/17543* (2013.01); *B41J 2/17553* (2013.01); *B41J 29/02* (2013.01); *B41J 29/13* (2013.01); *B41J 29/393* (2013.01)

(58) Field of Classification Search

CPC ..... B41J 2/17503; B41J 2/17543; B41J 2/17513; B41J 2/1752; B41J 2/1753; B41J 2/17553; B41J 29/02; B41J 29/13; B41J 29/393

USPC ..... 347/86

See application file for complete search history.

(56) References Cited

U.S. PATENT DOCUMENTS

| | | | | |
|---|---|---|---|---|
| 6,827,417 | B2 * | 12/2004 | Seino | B41J 2/17523 347/19 |
| 2002/0191046 | A1 * | 12/2002 | Otsuki | B41J 2/175 347/43 |
| 2003/0112457 | A1 * | 6/2003 | Akiyama | B41J 2/17566 358/1.14 |
| 2013/0314478 | A1 * | 11/2013 | Nozawa | B41J 2/17523 347/86 |
| 2015/0217585 | A1 | 8/2015 | Suzuki et al. | |

FOREIGN PATENT DOCUMENTS

| | | |
|---|---|---|
| WO | WO2014/024472 | 2/2014 |

* cited by examiner

*Primary Examiner* — Huan Tran
*Assistant Examiner* — Alexander D Shenderov
(74) *Attorney, Agent, or Firm* — Workman Nydegger

(57) ABSTRACT

A recording apparatus includes a carriage including a recording head that performs recording on a medium, the carriage being movable in a first direction and a second direction opposite to the first direction, and a control portion that controls the recording head and the carriage. The carriage has a first disposal section in which a first cartridge that supplies a liquid to the recording head is disposed and a second disposal section in which a second cartridge that does not supply a liquid to the recording head is disposed. The first cartridge includes a first information holder that holds information about the first cartridge. The second cartridge includes a second information holder that holds information about the second cartridge. The control portion executes a control of performing recording by using only the liquid contained in the first cartridge on the basis of the information held by the second information holder.

14 Claims, 13 Drawing Sheets

RECORDING APPARATUS

BACKGROUND

1. Technical Field

The present invention relates to a recording apparatus that performs recording on a recording target medium.

In this patent application, it is assumed that recording apparatuses are of various kinds, including a serial printer that performs recording while a recording head is moving in a predetermined direction, and a copying machine, a facsimile, etc. that are equipped with such printer functions.

2. Related Art

An example of the recording apparatuses is an ink jet printer (hereinafter, simply referred to as "printer") that executes recording by discharging ink from a recording head to a recording target medium. This printer performs recording on a recording target medium with inks of a plurality of colors by supplying different color inks to the recording head.

However, as for the printers as described above, there is great need not only for the recording on a recording target medium with a plurality of color inks in such fields as photography printing but also for the recording on a recording target medium in a single color, for example, through the use of only a black ink, in such fields as production of documents. There exists a recording apparatus that performs recording with only a single color (black) ink by utilizing a configuration of the recording apparatus designed to be capable of recording with a plurality of color inks, as described in International Publication No. WO2014/024472 A1.

A printer described in International Publication No. WO2014/024472 A1 includes, as a measure for supplying inks to a recording head, large-capacity ink tanks that hold ink outside an apparatus main body. The inks are supplied from the ink tanks to the recording head via ink tubes. More concretely, a carriage that has the recording head is provided with a plurality of fitting portions to which adapters to which the ink tubes extending from the ink tanks are connected are able to be fitted. In the foregoing printer, only one adapter is attached to a plurality of attachment portions. Then, only the single color ink (e.g., a black ink) supplied from one of the ink tanks is used to perform recording on a recording target medium.

However, if a printer that has a plurality of fitting portions to which an adapter as mentioned above or ink cartridges that contain inks can be fitted is used with an adapter or an ink cartridge attached to only one or more, but not all, of the fitting portions, the carriage may not be able to keep its balance, leading to a risk of reducing the quality of recording.

SUMMARY

An advantage of some aspects of the invention is that a recording apparatus capable of restraining a reduction in recording quality is provided.

A recording apparatus according to a first aspect of the invention includes a carriage which includes a recording head that performs recording on a medium and which is movable in a first direction and a second direction opposite to the first direction and a control portion that controls the recording head and the carriage. The carriage includes a first disposal section in which a first cartridge that supplies a liquid to the recording head is disposed and a second disposal section in which a second cartridge that does not supply a liquid to the recording head is disposed. The first cartridge includes a first information holder that holds information about the first cartridge. The second cartridge includes a second information holder that holds information about the second cartridge. The control portion executes a control of performing recording by using no liquids supplied via the carriage but the liquid contained in the first cartridge and supplied via the carriage on the basis of the information held by the second information holder.

According to this aspect of the invention, the control portion is able to recognize, via the second information holder, a state in which the second cartridge is disposed in the second disposal section. Then, on the basis of this recognition or determination, the control portion performs a recording operation by using the liquid contained in the first cartridge and no other liquids supplied via the carriage. That is, the recording operation is performed, with the carriage being in a balanced state, so that reduction in recording quality can be restrained.

A recording apparatus according to a second aspect of the invention includes a carriage which includes a recording head that performs recording on a medium and which is movable in a first direction and a second direction opposite to the first direction and a control portion that controls the recording head and the carriage. The carriage includes a first disposal section in which a first cartridge that supplies a liquid to the recording head is disposed and a second disposal section in which a second cartridge that does not supplies a liquid to the recording head is disposed. The first cartridge includes an information holder that holds information about the first cartridge. The control portion executes a control of performing recording by using no liquids supplied via the carriage but the liquid contained in the first cartridge and supplied via the carriage while the second cartridge is disposed in the second disposal section, on the basis of the information that the second cartridge has been disposed in the second disposal section.

According to this aspect, during the state in which the first cartridge is disposed in the first disposal section of the carriage that has the first disposal section and the second disposal section and in which the second cartridge is disposed in the second disposal section, the control portion executes the control of performing recording by using the liquid contained in the first cartridge and no other liquids supplied via the carriage. That is, the recording operation is performed, with the carriage being in a balanced state, so that reduction in recording quality can be restrained.

In the foregoing recording apparatuses, the control portion may execute the control of performing recording by using no liquids supplied via the carriage but the liquid contained in the first cartridge and supplied via the carriage, with the second cartridge disposed in the second disposal section, on the basis of information from a detector that detects that the second cartridge has been disposed in the second disposal section.

According to this embodiment, since the recording head is provided with no liquid discharge nozzles but the liquid discharge nozzle that discharges the liquid supplied from the first cartridge, the configuration of the recording head can be simplified and costs can be reduced.

In any one of the foregoing recording apparatuses, a region that the second cartridge occupies in the carriage may be larger than a region that the first cartridge occupies in the carriage.

According to this embodiment, the second cartridge is larger in size than the first cartridge, so that if the carriage were operated in a state in which the second cartridge has been removed, the carriage would become ill balanced. However, in this embodiment, the carriage is in a state in which the second cartridge has been disposed, that is, the carriage is in a balanced state, when the recording operation is executed.

In the foregoing recording apparatuses described above, it is permissible that the second cartridge not contain liquid.

According to this embodiment, the second cartridge with no liquid contained is disposed in the second disposal section, so that the leakage of liquid from the second cartridge in the recording apparatus can be prevented.

In this recording apparatus, an upper surface of the second cartridge may have an atmospherically open hole that provides communication between an inside of the second cartridge and an outside of the second cartridge.

In this embodiment, the upper surface of the second cartridge has the atmospherically open hole that provides communication between the inside and the outside of the second cartridge. Note that when the ink contained in the first cartridge is supplied to the recording head, it sometimes happens that moisture from the ink in the recording head permeates to the second cartridge and the pressure in the second cartridge increases. However, according to this embodiment, when the pressure in the second cartridge increases, gas inside the second cartridge is let out of the second cartridge through the atmospherically open hole and therefore the pressure in the second cartridge decreases. Therefore, the possibility of the pressure in the second cartridge becoming excessively high and damaging a portion of the recording head can be reduced.

In any one of the foregoing recording apparatuses, the liquid supplied from the first cartridge to the recording head may be a black ink.

According to this embodiment, since the liquid supplied from the first cartridge to the recording head is black ink, it is possible to easily use the recording apparatus as a monochrome recording-dedicated machine by using an existing configuration of the recording apparatus.

In the foregoing recording apparatus according to the first aspect of the invention, the second cartridge may be detachably attachable to the second disposal section and a third cartridge that contains a liquid may be fittable to the second disposal section.

According to this embodiment, since the second disposal section is capable of receiving not only the second cartridge but also the third cartridge that contains inks, the carriage 40 can have the same configuration as carriages used in recording apparatuses in which a first cartridge and a third cartridge both containing ink are fitted to a carriage to perform recording and therefore costs can be reduced.

In this recording apparatus, the third cartridge may include a third information holder that holds information about the third cartridge and the information held by the second information holder may be different from the information held by the third information holder.

Furthermore, in this recording apparatus, the control portion may perform the control so as not to operate the carriage on the basis of the information held by the third information holder while the third cartridge is disposed in the second disposal section.

According to this embodiment, while the third cartridge is disposed in the second disposal section, the control portion performs the control so as not to operate the carriage. That is, the control portion does not operate the carriage unless the second cartridge has been disposed in the second disposal section. Therefore, operation of the recording apparatus with a wrongly disposed cartridge can be prevented.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
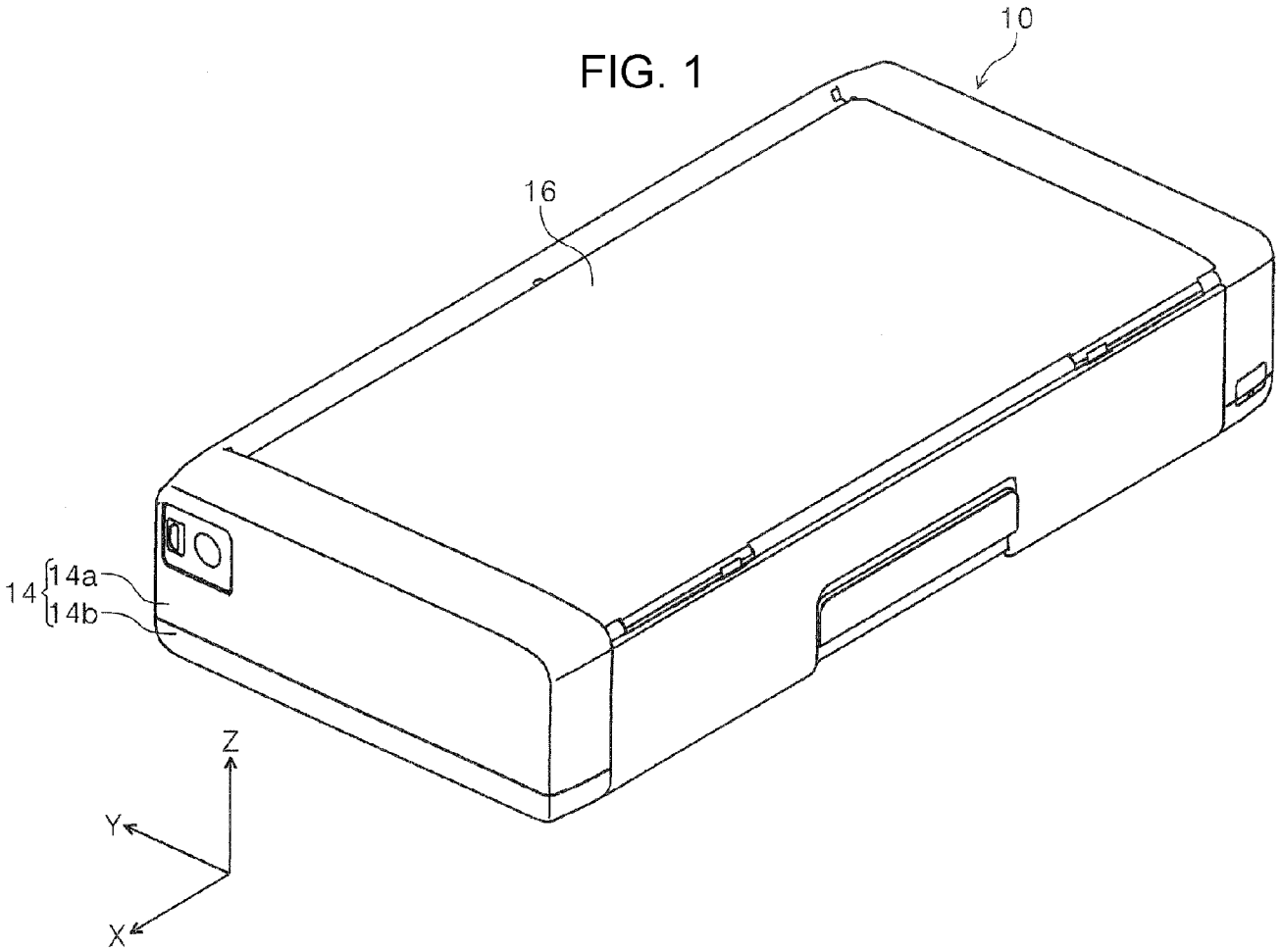
FIG. 1 is an external perspective view showing a state in which a cover of a printer according to the invention is closed.

Hereinafter, exemplary embodiments of the invention will be described with reference to the drawings. In the following exemplary embodiments, like configurations will be indicated by like reference numerals and will be described only in exemplary embodiments in which the like configurations are mentioned for the first time and will not be described in the subsequent exemplary embodiments.

Figure 2:
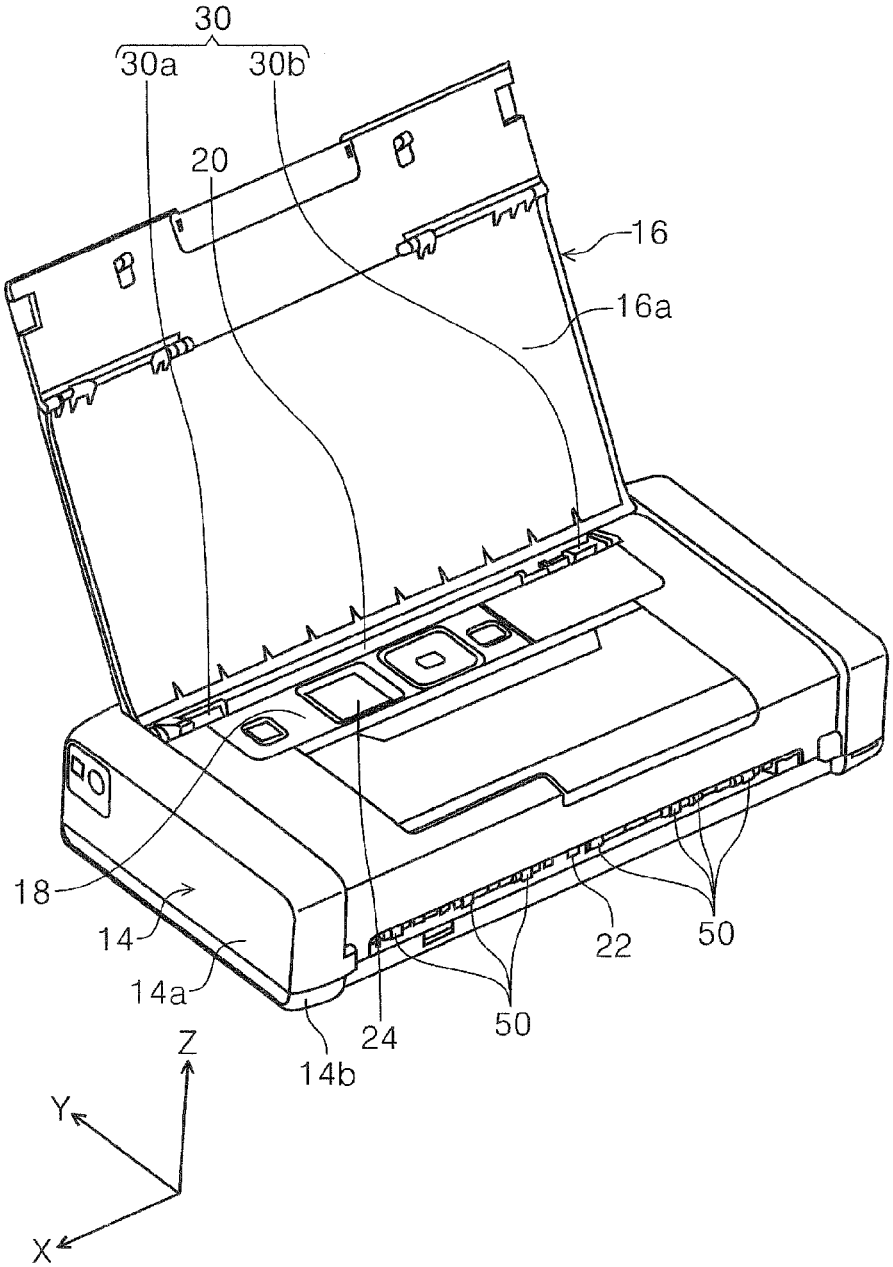
FIG. 2 is an external perspective view showing a state in which the cover of the printer according to the invention is open.
Figure 3:
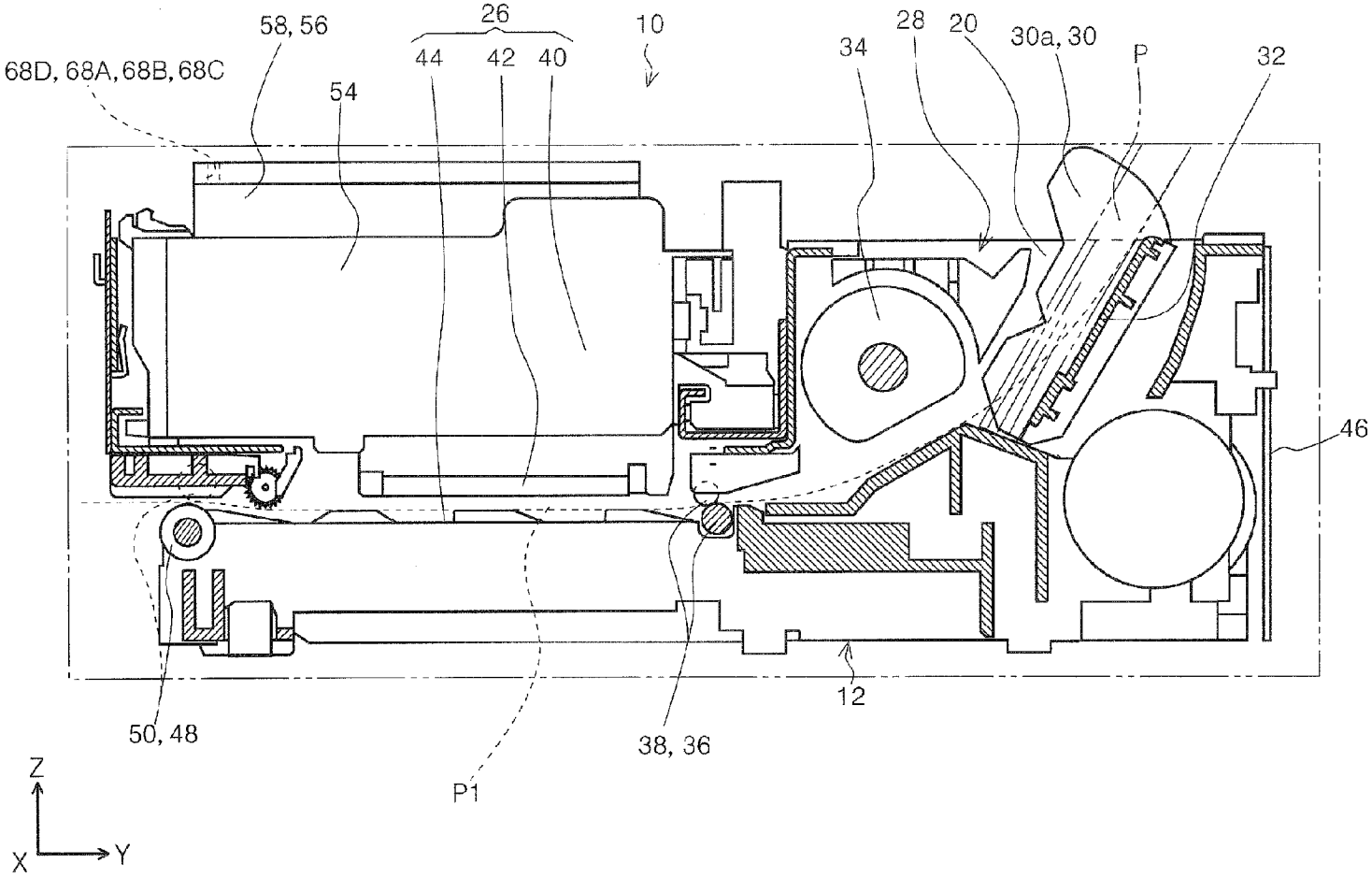
FIG. 3 is a side sectional view showing a sheet transport path in a printer according to the invention.
Figure 4:
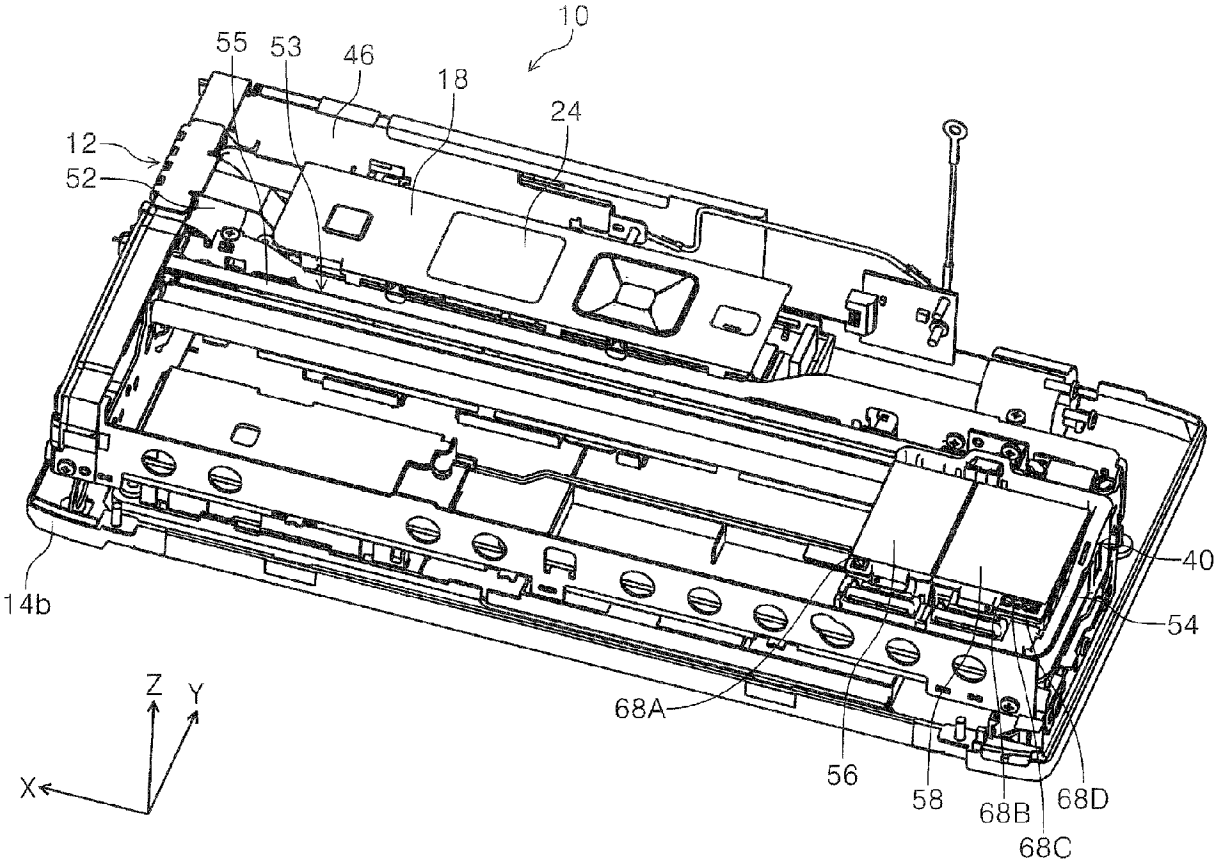
FIG. 4 is a perspective view showing an apparatus main body of the printer according to the invention.
Figure 5:
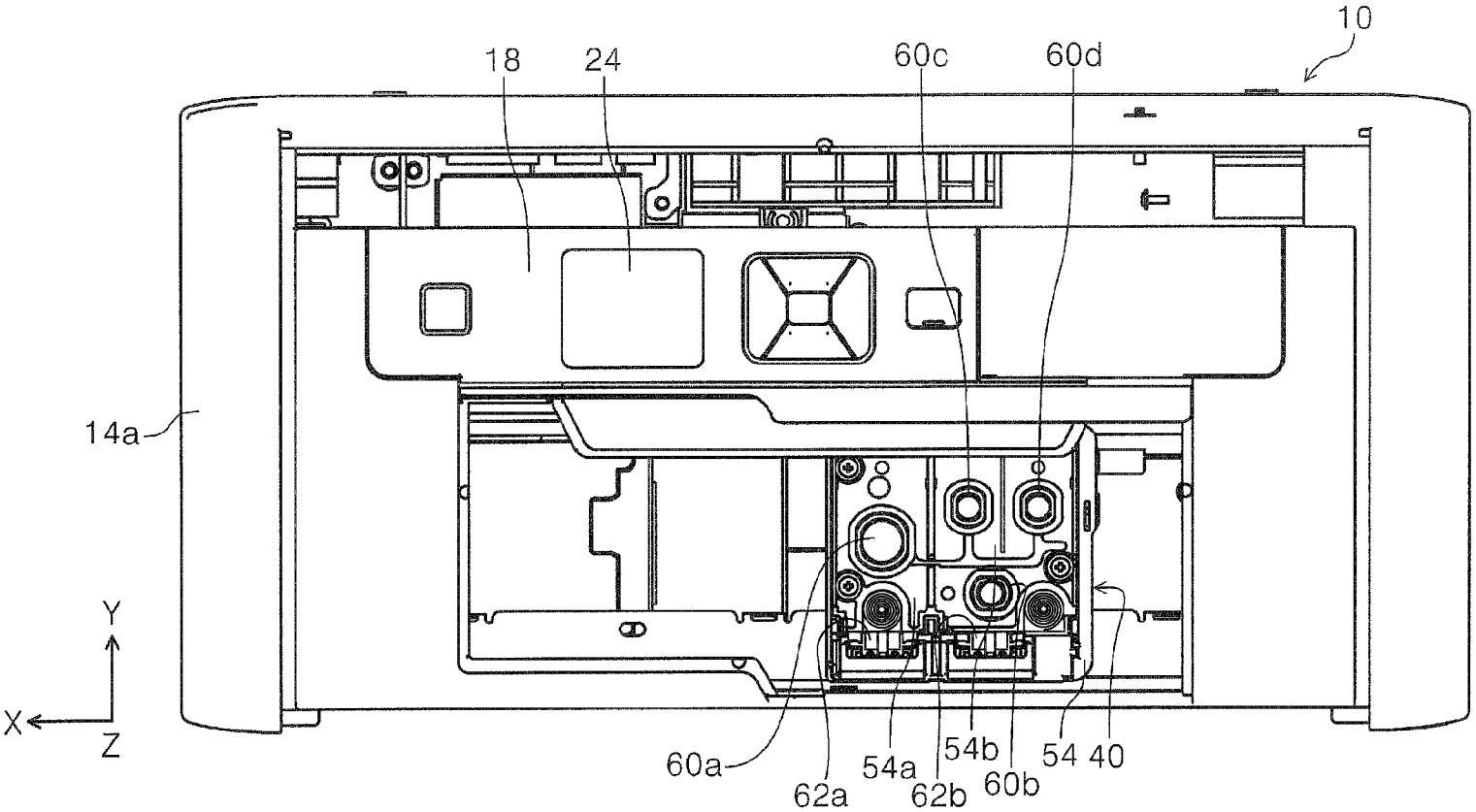
FIG. 5 is a plan view of the printer according to the invention.
Figure 6:
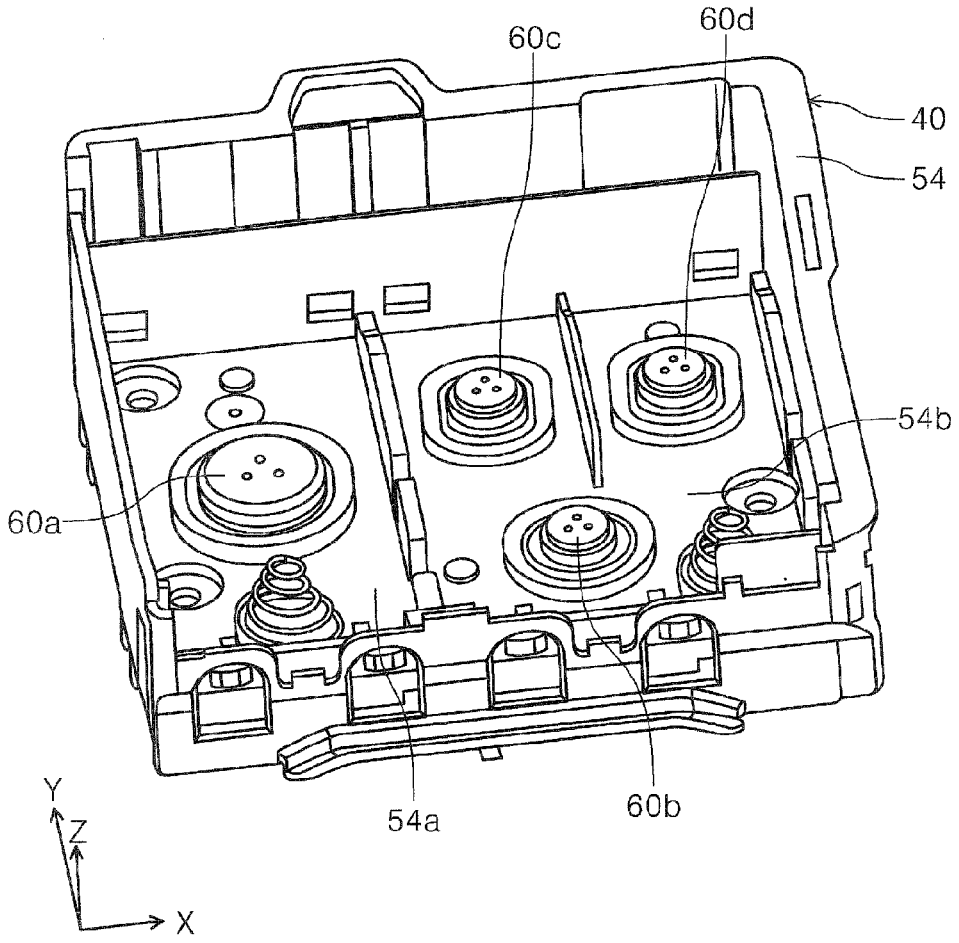
FIG. 6 is a perspective view of a carriage according to the invention.

FIG. 1 is an external perspective view showing a state in which a cover of a printer according to the invention. FIG. 2 is an external perspective view showing a state in which the cover of the printer according to the invention is open. FIG. 3 is a side sectional view showing a sheet transport path in the printer according to the invention. FIG. 4 is a perspective view showing an apparatus main body of the printer according to the invention. FIG. 5 is a plan view of the printer according to the invention. FIG. 6 is a perspective view of a carriage according to the invention.

Figure 7:
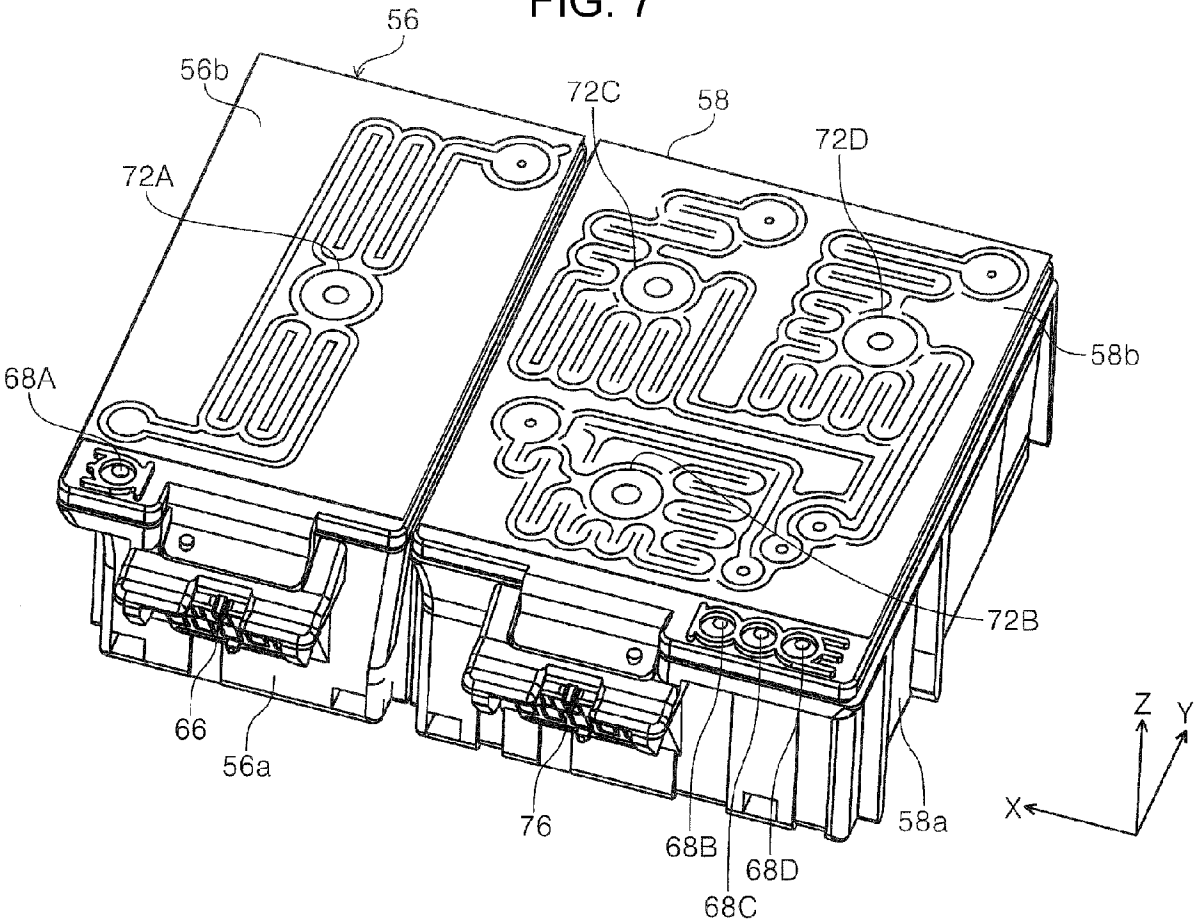
FIG. 7 is a perspective view of a first cartridge and a second cartridge according to the invention which is taken from above.
Figure 8:
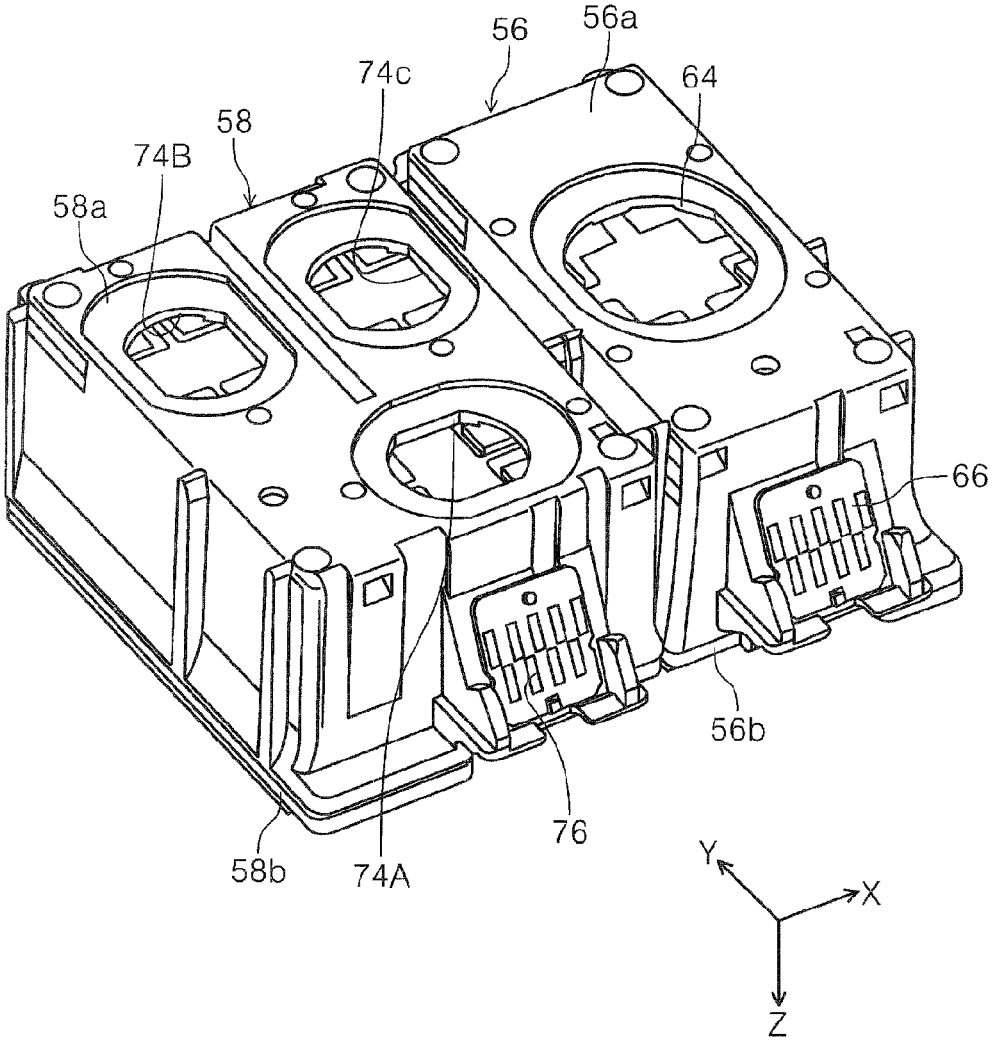
FIG. 8 is a perspective view of the first cartridge and the second cartridge according to the invention viewed from below.
Figure 9:
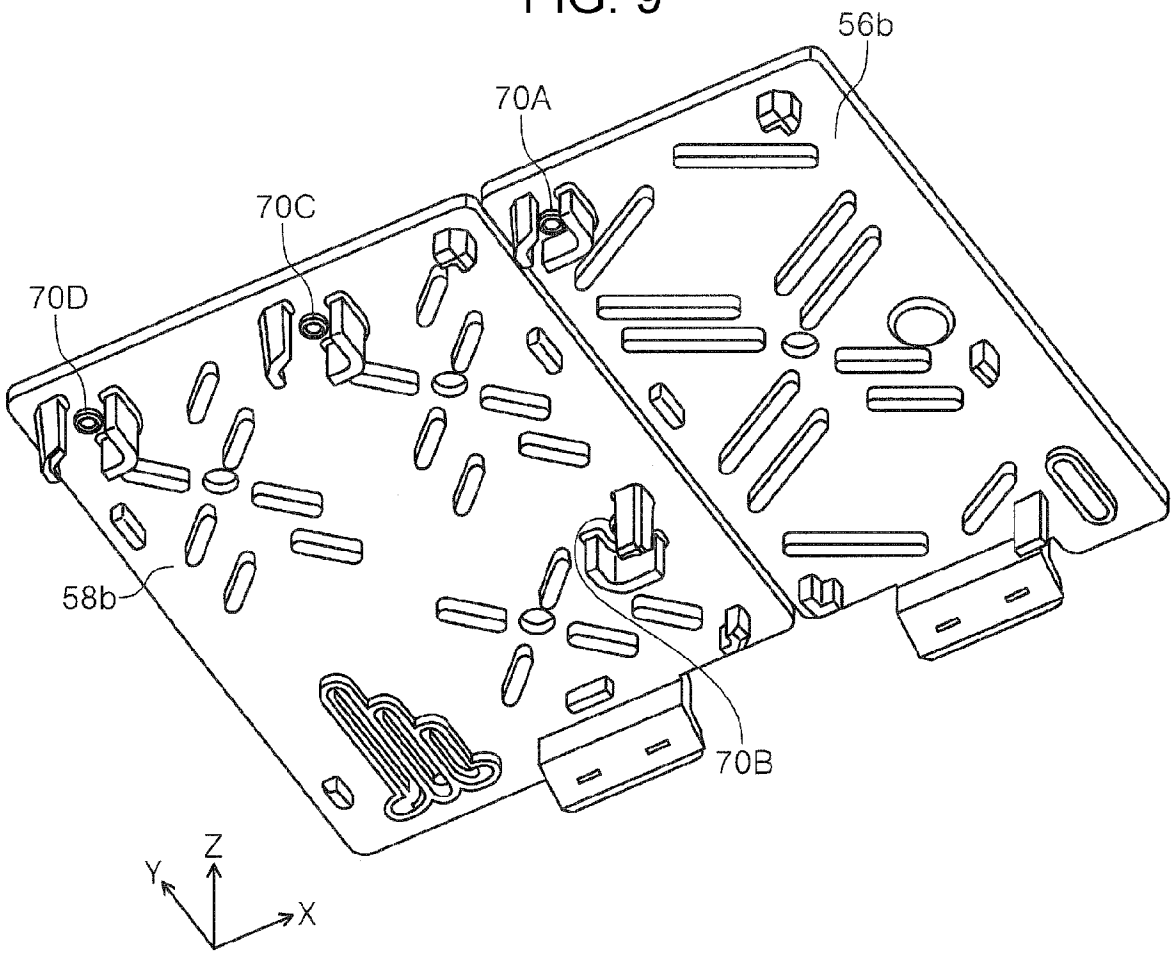
FIG. 9 is a perspective view of lid portions of the first cartridge and the second cartridge viewed from below.
Figure 10:
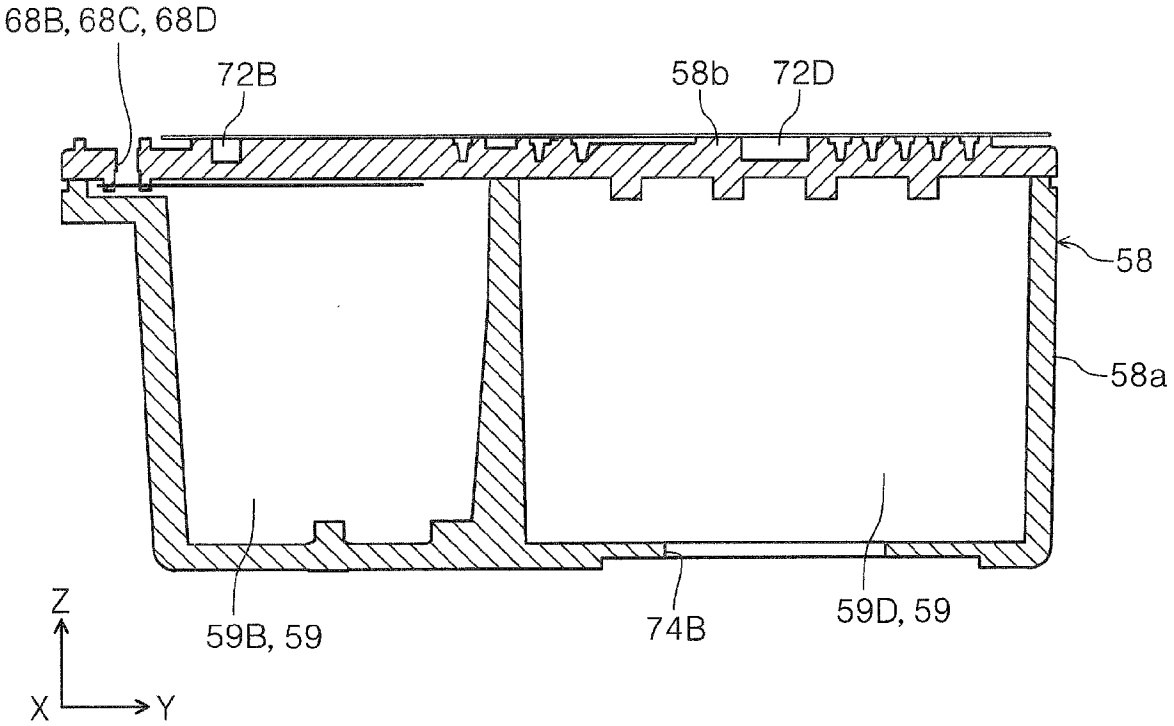
FIG. 10 is a side sectional view of the second cartridge.
Figure 11:
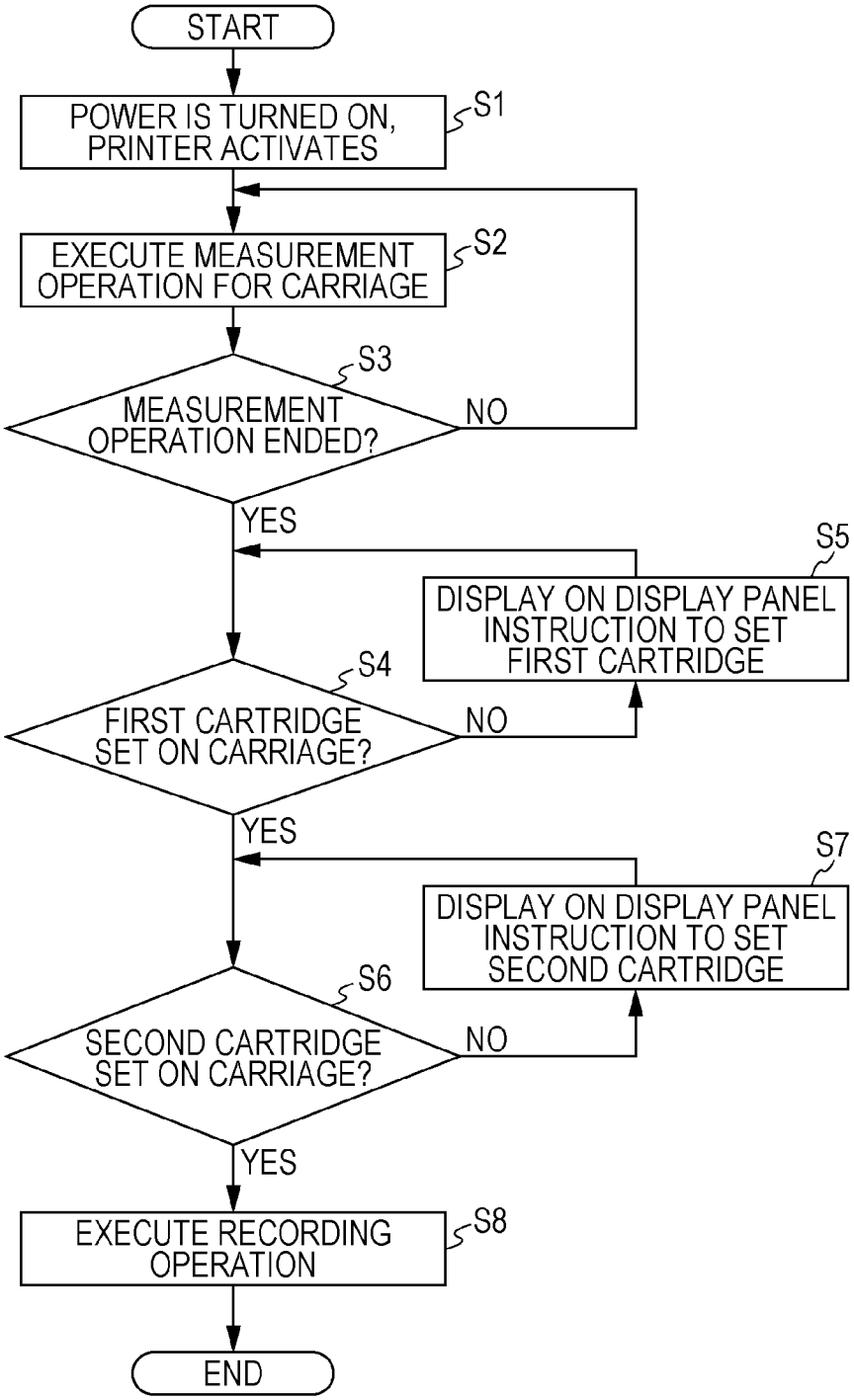
FIG. 11 is a flowchart of execution of a recording operation of a printer according to a first exemplary embodiment of the invention.
Figure 12:
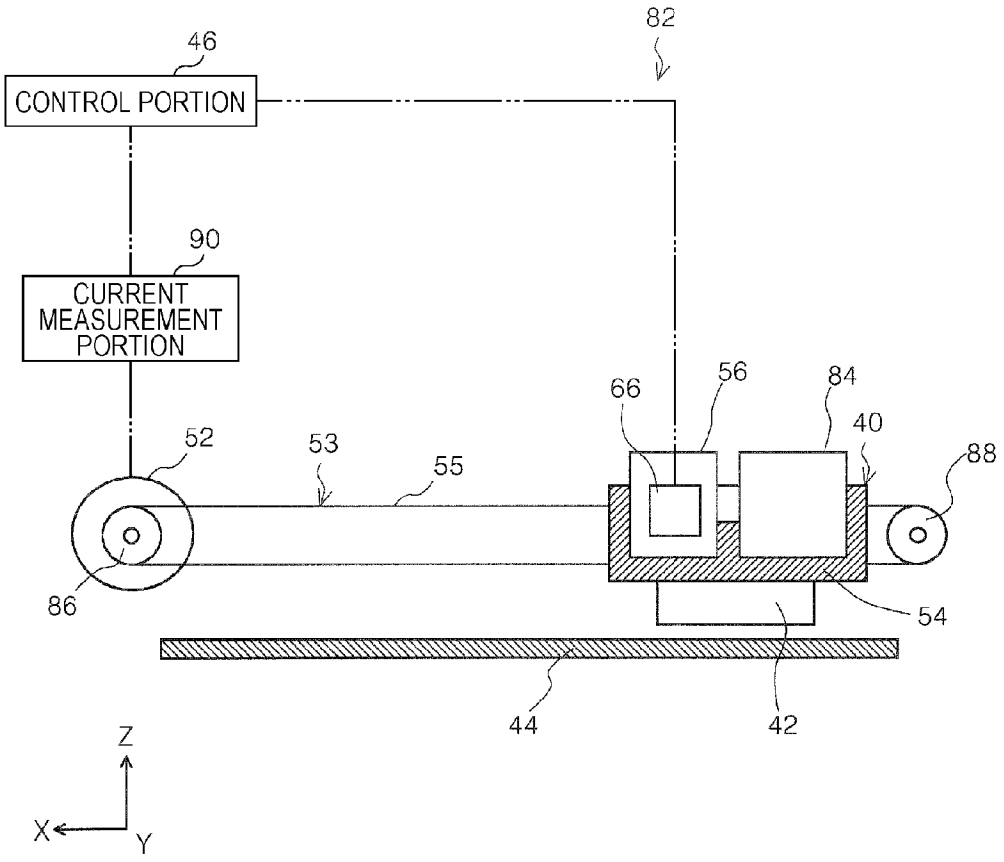
FIG. 12 is a general diagram of a printer according to a second exemplary embodiment of the invention.
Figure 13:
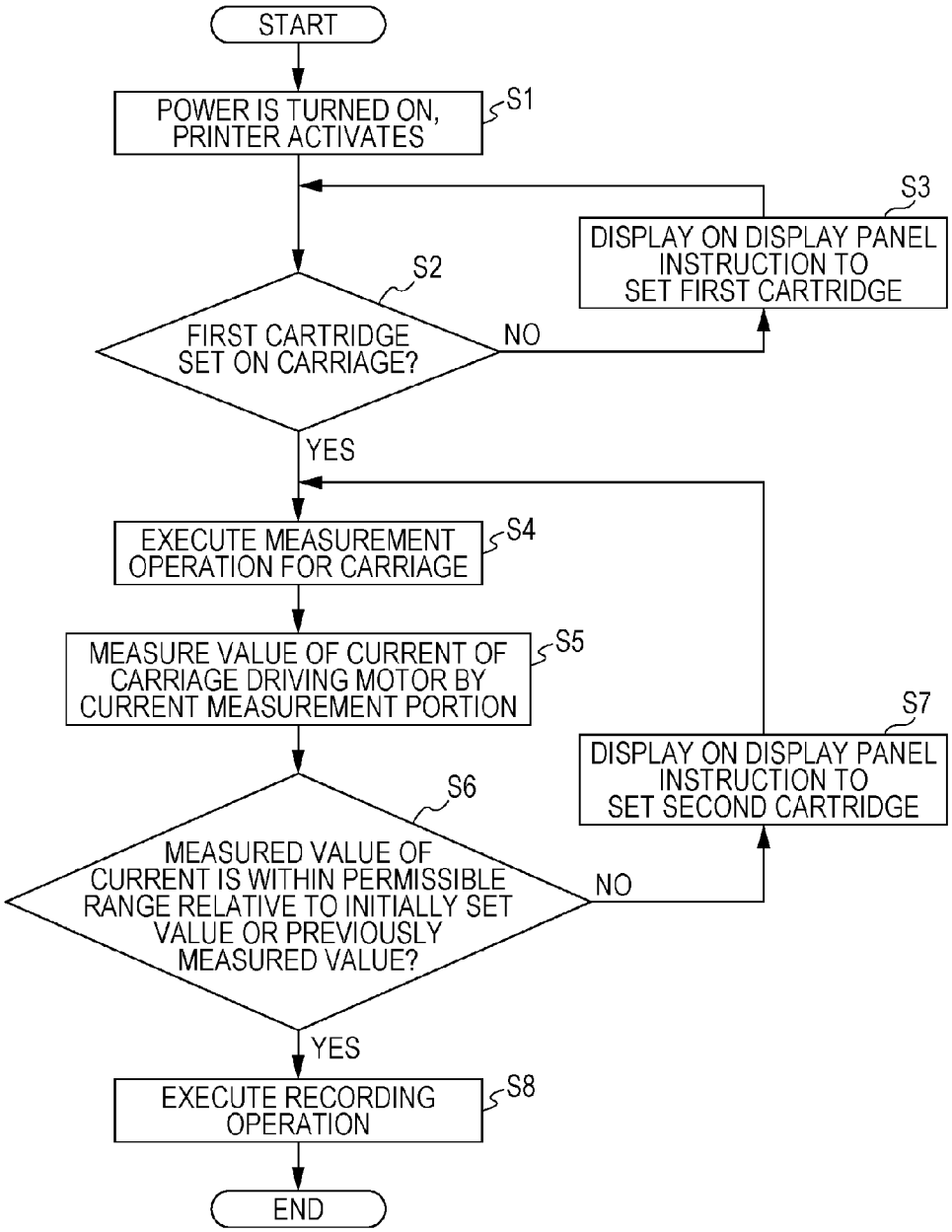
FIG. 13 is a flowchart of execution of a recording operation of the printer according to the second exemplary embodiment of the invention.

FIG. 7 is a perspective view of a first cartridge and a second cartridge according to the invention viewed from above. FIG. 8 is a perspective view of the first cartridge and the second cartridge according to the invention viewed from below. FIG. 9 is a perspective view of lid portions of the first cartridge and the second cartridge viewed from below. FIG. 10 is a side sectional view of the second cartridge. FIG. 11 is a flowchart of execution of a recording operation of a printer according to a first exemplary embodiment of the invention. FIG. 12 is a general diagram of a printer according to a second exemplary embodiment of the invention. FIG. 13 is a flowchart of execution of a recording operation of the printer according to the second exemplary embodiment.

Furthermore, in the XYZ coordinate system indicated in drawings, an X direction represents a width direction of the apparatus and a sheet width direction, a Y direction represents a depth direction of the apparatus and a sheet transport direction, and a Z direction indicates a height direction of the apparatus. Incidentally, in the drawings, a negative Y direction is a direction in which a front surface of the apparatus faces and the positive Y direction is a direction in which a rear surface of the apparatus faces.

First Exemplary Embodiment

Overview of Printer

With reference to FIGS. 1 to 4, component elements of an ink jet printer 10 (hereinafter, referred to as "printer 10") as an example of a recording apparatus will be described. The printer 10 includes an apparatus main body 12 (see FIG. 4), a housing 14 that surrounds the apparatus main body 12 and that forms an exterior of the printer 10, a cover 16 capable of being closed and opened relative to the apparatus main body 12, and an operation portion 18 (see FIG. 2 and FIG. 4) that is exposed on an upper portion of the apparatus main body 12 when the cover 16 is in an open posture (see FIG. 2). The housing 14 includes an upper portion housing 14*a* and a lower portion housing 14*b*.

The cover 16, when closed, constitutes portions of an upper surface and a front surface of the printer 10 (see FIG. 1). The cover 16 is pivotably attached to the apparatus main body 12. When the cover 16 is pivoted counterclockwise in FIG. 2 from a front side of the apparatus main body 12 (a side in the negative Y axis direction in FIG. 2) to a rear side of the apparatus main body 12 (a side in the positive Y axis direction). In this exemplary embodiment, when the cover 16 is in a posture of being open relative to the apparatus main body 12 as shown in FIG. 2, an internal surface of the cover 16 functions as a mount surface 16*a* for a sheet P as a "recording target medium".

When the cover 16 is turned from the closed posture (see FIG. 1) to the open posture as shown in FIG. 2, the operation portion 18 and a sheet supply opening 20 are exposed on an upper portion of the apparatus main body 12 while a discharge port 22 is exposed on a front surface of the apparatus main body 12. The operation portion 18 has a power button, a print setting button, a display panel 24, etc. which are provided to operate the printer 10.

Furthermore, the sheet supply opening 20 is an opening through which a sheet P mounted on the mount surface 16*a* of the cover 16 is supplied from the mount surface 16*a* into the apparatus main body 12. The discharge port 22 allows the sheet P supplied from the mount surface 16*a* in the apparatus main body 12 through the sheet supply opening 20 to be let out to an apparatus front surface side (the negative Y axis direction side in FIG. 2) after recording on the sheet P has been executed by a recording portion 26 (described below).

Overview of Sheet Transport Path

Next, component elements on the sheet transport path will be further described in detail with reference to FIG. 3. In FIG. 3, the right side in the drawing (apparatus back surface side) is an upstream side along the feed path (sheet transport path) and the left side in the drawing (apparatus front surface side) is a downstream side along the feed path. Furthermore, an interrupted line indicated by reference character P1 in FIG. 3 represents the transport path of the sheet P.

On the feed path upstream side there is provided a sheet supply portion 28 that feeds the sheet P from the mount surface 16*a* of the cover 16 that is open relative to the housing 14 to the feed path downstream side. The sheet supply portion 28 includes the sheet supply opening 20, a pair of sheet guides 30 provided at the sheet supply opening 20, a sheet support portion 32 that supports at least a part of the sheet P fed from the sheet supply opening 20, and a feed roller 34 provided at a location that faces the sheet support portion 32. Note that the cover 16 and the sheet support portion 32 together support the sheet P in an inclined posture.

The two sheet guides 30 include a sheet guide 30*a* positioned at a positive X axis direction side in the X axis direction in FIG. 2 and a sheet guide 30*b* positioned at the negative X axis direction side. The sheet guide 30*a* is movable along the X axis direction so as to be moved toward and away from the sheet guide 30*b* positioned at the negative X axis direction side. That is, the sheet guide 30*a* is provided so that a user can slide the sheet guide 30*a* in the sheet width direction (X direction) according to the sheet size.

The sheet support portion 32 has been formed so as to slope downward to a negative Y direction side in FIG. 3. Furthermore, the feed roller 34 is swingable in such directions as to move to and away from the sheet P mounted on the sheet support portion 32. The feed roller 34, when displaced in the direction to the sheet support portion 32, contacts the uppermost sheet P in the stack of sheets mounted on the sheet support portion 32 and feeds the uppermost sheet P to the feed path downstream side.

A transport portion 36 is provided on the downstream side of the sheet supply portion 28. The transport portion 36 is provided with a transport roller pair 38. The transport roller pair 38 is rotationally driven by a drive source (not graphically shown). The transport portion 36, using the transport roller pair 38, nips the sheet P fed from the sheet supply portion 28 and transports the sheet P to the downstream side in the transport direction. At the downstream side of the transport portion 36 there is a recording portion 26.

The recording portion 26 includes a carriage 40, a recording head 42 provided in a bottom portion of the carriage 40, and a platen 44 that faces the recording head 42 and that supports the recording target medium. The recording head 42 faces the sheet P that is supported by the platen 44. The carriage 40 is driven so as to move back and forth in the X axis directions (the positive X axis direction and the negative X axis direction) in FIG. 4 that are a "first direction" and the "second direction that is opposite to the first direction" by a carriage driving motor 52 (see FIG. 4) that is controlled by a control portion 46 that is provided inside the apparatus main body 12. Furthermore, the platen 44, which supports the sheet P from below, defines the distance (gap) between a recording surface of the medium and a head surface of the recording head 42.

In the recording portion 26, when the sheet P supported by the platen 44 faces the recording head 42, ink as a "liquid" is discharged from a plurality of nozzle holes (not graphically shown) of the recording head 42 toward the sheet P and the ink lands on the recording surface of the sheet P (the surface that faces the recording head 42), whereby recording is executed.

A discharge unit 48 is provided at the downstream side of the recording portion 26 in the transport direction. The discharge unit 48 includes a driving sheet discharge roller pair 50. The sheet P having been subjected to recording in the recording portion 26 is nipped by the driving sheet discharge roller pair 50 and then discharged from the discharge port 22 formed in the apparatus front surface to a front of the apparatus. Note that the driving sheet discharge roller pair 50 is rotationally driven by a driving motor (not graphically shown).

Furthermore, the control portion 46 is provided in a back surface-side end portion of the apparatus main body 12 in this exemplary embodiment. The control portion 46, according to instructions input from the operation portion 18, controls operations needed in order to execute recording on the sheet P in the printer 10 such as the feeding, transporting, discharging, and recording operations that are performed with respect to sheets by the transport portion 36, the recording portion 26, and the discharge unit 48. Further, the control portion 46 controls the rotational driving of a carriage driving motor 52 (see FIG. 4).

About Carriage

The carriage 40 in this exemplary embodiment will be described with reference to FIG. 4 to FIG. 6. In the exemplary embodiment, the carriage 40 is movable back and forth in the positive X axis direction and the negative X axis direction by a carriage driver 53 that drives the carriage 40 by receiving drive force from the carriage driving motor 52. The carriage driver 53 includes a driving pulley (not graphically shown) provided on a driving shaft of the carriage driving motor 52, a driven roller (not graphically shown) disposed at a distance from the driving pulley in the X axis directions, and an endless belt 55 wrapped around the driving pulley and the driven pulley.

In an example configuration of this exemplary embodiment, a portion of the carriage 40 grips a portion of the endless belt 55. Therefore, when the carriage driving motor 52 is driven, the endless belt 55 rotates, moving the carriage 40 in the X axis direction. It is assumed that the location at which the carriage 40 is in FIG. 4 is a home position of the carriage 40. Note that FIG. 5 omits the cover 16.

The carriage 40 includes a box-shaped casing 54 that has an upward opening and the recording head 42 (see FIG. 3) that is provided in a lower portion of the casing 54. The box-shaped casing 54 is provided with a first disposal section 54*a* in which a first cartridge 56 (described below) is disposed and a second disposal section 54*b* in which a second cartridge 58 (described below) is disposed.

In the exemplary embodiment, the first disposal section 54*a* is provided with an ink supply portion 60*a* that supplies an ink to the recording head 42 and with a connection portion 62*a* (see FIG. 5). The ink supply portion 60*a* is connected to a flow path (not graphically shown) that is provided within the recording head 42. The flow path is connected to an ink discharge nozzle (not graphically shown) that is provided in a lower portion of the recording head 42. That is, when the first cartridge 56 is disposed in or fitted to the first disposal section 54*a*, the ink is supplied from the first cartridge 56 to the ink supply portion 60*a*, so that the ink can be discharged from the ink discharge nozzle to the sheet P after passing through the flow path. In this exemplary embodiment, the connection portion 62*a* is electrically connected to the control portion 46. The connection portion 62*a* will be described later.

The second disposal section 54*b* is provided with ink supply portions 60*b*, 60*c* and 60*d* connected to flow paths (not graphically shown) inside the recording head 42 and is also provided with a connection portion 62*b* (see FIG. 5). Note that the recording head 42 in this exemplary embodiment is not provided with an ink discharge nozzle that corresponds to the flow paths (not graphically shown) that are connected respectively to the ink supply portions 60*b*, 60*c* and 60*d*. That is, the recording head 42 in this exemplary embodiment is configured to be capable of discharging only the ink supplied from the first cartridge 56. Furthermore, in this exemplary embodiment, the connection portion 62*b* is electrically connected to the control portion 46. The connection portion 62*b* will be described later.

About Cartridge

The first cartridge 56 and the second cartridge 58 will be described with reference to FIG. 7 to FIG. 10. The first cartridge 56 includes a box-shaped cartridge body 56*a* and a lid member 56*b*. The lid member 56*b* is attached to an upper portion of the cartridge body 56*a*. Inside the cartridge body 56*a* there is formed an internal space for containing ink. In this exemplary embodiment, for example, a black ink is contained in the internal space of the first cartridge 56. An ink supply opening 64 (see FIG. 8) is provided in a lower portion of the first cartridge 56. When the first cartridge 56 is disposed in or fitted to the first disposal section 54*a*, the ink supply opening 64 closely contacts the ink supply portion 60*a* and supplies the black ink contained in the first cartridge 56 to the recording head 42 via the ink supply portion 60*a*.

The first cartridge 56 is further provided with a first information holder 66. In this exemplary embodiment, the first information holder 66 is configured as a circuit substrate. More concretely, the first information holder 66 includes a memory element that stores information about the kind and remaining amount of the ink contained in the first cartridge 56, and the like, and thus holds information about the first cartridge 56. When the first cartridge 56 is disposed in or fitted to the first disposal section 54*a*, the first information holder 66 contacts the connection portion 62*a* of the carriage 40. As a result, the first information holder 66 is electrically connected to the control portion 46. Then, the first information holder 66 and the control portion 46 send and receive information about the first cartridge 56 to and from each other.

The lid member 56*b* has in its upper surface an atmospherically open hole 68A (see FIG. 7). A lower surface of the lid member 56*b* has a hole 70A. Within the lid member 56*b* there is provided an atmospherically open flow path 72A of which an end communicates with the atmospherically open hole 68A and another end communicates with the hole 70A.

In this exemplary embodiment, when the pressure in the internal space of the first cartridge 56 becomes high, gas in the internal space is discharged to the outside of the first cartridge 56 through the hole 70A, the atmospherically open flow path 72A, and the atmospherically open hole 68A. In consequence, the pressure in the internal space of the first cartridge 56 decreases. Conversely, when the pressure in the internal space of the first cartridge 56 becomes low, outside air flows into the first cartridge 56 through the atmospherically open hole 68A, the atmospherically open flow path 72A, and the hole 70A. In consequence, the pressure in the internal space of the first cartridge 56 returns to an atmospheric level. That is, the atmospherically open hole 68A, the atmospherically open flow path 72A, and the hole 70A adjust the pressure inside the first cartridge 56 to a constant level.

Next, the second cartridge 58 will be described. The second cartridge 58 is configured as a color ink cartridge that contains a plurality of inks of different colors, for example, magenta, cyan, yellow, etc. However, in this exemplary embodiment, the second cartridge 58 does not contain such inks but is empty, and is disposed in or fitted to the second disposal section 54*b* of the carriage 40.

The second cartridge 58 includes a box-shaped cartridge body 58*a* and a lid member 58*b*. The lid member 58*b* is attached to an upper portion of the cartridge body 58*a* so as to define within the cartridge body 58*a* internal spaces 59 (see FIG. 10) in which to contain the inks. In this exemplary embodiment, the inside of the second cartridge 58 is divided into three internal spaces 59 as an example configuration. Incidentally, an internal space indicated by reference character 59B in FIG. 10 communicates with an atmospherically open hole 68B (described below) and an internal space indicated by reference character 59D communicates with an atmospherically open hole 68D. Note that FIG. 10 omits an internal space that communicates with an atmospherically open hole 68C (described below).

A lower portion of the second cartridge 58 has opening portions 74A, 74B and 74C that respectively correspond to the three internal spaces 59. When the second cartridge 58 is disposed in or fitted to the second disposal section 54*b*, the opening portions 74A, 74B and 74C closely contact the ink supply portions 60*b*, 60*c* and 60*d*, respectively.

The second cartridge 58 is provided with a second information holder 76. In this exemplary embodiment, the second information holder 76 is configured as a circuit substrate. More concretely, the second information holder 76 includes a memory element that stores information that the second cartridge 58 has been configured as a dummy cartridge that does not contain ink, and thus holds information about the second cartridge 58. When the second cartridge 58 is disposed in or fitted to the second disposal section 54*b*, the second information holder 76 contacts the connection portion 62*b* of the carriage 40. As a result, the second information holder 76 is electrically connected to the control portion 46. Then, the second information holder 76 and the control portion 46 send and receive information about the second cartridge 58 to and from each other.

An upper surface of the lid member 58*b* has atmospherically open holes 68B, 68C and 68D (see FIG. 7). A lower surface of the lid member 58*b* has holes 70B, 70C and 70D. Within the lid member 58*b* there are provided an atmospherically open flow path 72B of which an end communicates with the atmospherically open hole 68B and another end communicates with the hole 70B, an atmospherically open flow path 72C of which an end communicates with the atmospherically open hole 68C and another end communicates with the hole 70C, and an atmospherically open flow path 72D of which an end communicates with the atmospherically open hole 68D and another end communicates with the hole 70D.

The atmospherically open holes 68B, 68C and 68D, the holes 70B, 70C and 70D, and the atmospherically open flow paths 72B, 72C and 72D function to maintain a constant pressure in the three internal spaces of the second cartridge 58.

Referring back to FIG. 4 and FIG. 7, the first cartridge 56 is disposed at a side on the carriage 40 which is opposite to the home position and the second cartridge 58 disposed at a home position side on the carriage 40. That is, in this exemplary embodiment, the first cartridge 56 is positioned at a side that is closer in an apparatus width direction to a transport region of the sheet P. Note that, in the recording head 42 in this exemplary embodiment, an ink discharge nozzle (not graphically shown) that discharges the ink contained in the first cartridge 56 is disposed at the side closer in the apparatus width direction to the transport region of the sheet P. Therefore, in this exemplary embodiment, when the recording on the sheet P is to be executed by using no inks but the one contained in the first cartridge 56, it suffices that the carriage 40 is moved from the home position to a location at which the ink discharge nozzle that corresponds to the first cartridge 56 faces an end portion of the sheet P which is opposite to the home position and there is no need to move a region of the carriage 40 in which the second cartridge 58 is disposed to the location at which the ink discharge nozzle that corresponds to the first cartridge 56 faces the foregoing end portion of the sheet P. As a result, the amount of movement of the carriage 40 in the apparatus width direction during the recording operation can be reduced and the throughput of the printer 10 can be improved. Furthermore, it is designed that the region that the second cartridge 58 occupies in the carriage 40 is larger than the region that the first cartridge 56 occupies in the carriage 40.

Furthermore, while the first cartridge 56 containing the black ink and the second cartridge 58 not containing ink are fitted to the carriage 40, the black ink contained in the first cartridge 56 flows into a flow path (not graphically shown) that is provided within the recording head 42. Note that since, within the recording head 42, the flow path that corresponds to the ink of the first cartridge 56 and the flow paths that correspond to the second cartridge 58 are disposed near to each other, it sometimes happens that moisture of the ink permeates from the flow path that corresponds to the first cartridge 56 to a flow path that corresponds to the second cartridge.

The moisture having permeated in this manner reversely passes through the flow path that corresponds to the second cartridge 58 and reaches the corresponding internal space 59 (see FIG. 10) of the second cartridge 58. Then, if the temperature in the second cartridge 58 changes, the pressure in the internal space 59 increases. However, since the internal spaces 59 function to keep the pressure in the internal spaces 59 constant because of the atmospherically open hole 68B, 68C and 68D, the holes 70B, 70C and 70D, and the atmospherically open flow paths 72B, 72C and 72D, the possibility of the pressure in any one of the internal spaces 59 becoming excessively high and therefore pressurizing the flow path that communicates with that internal space 59 and damaging the recording head 42 can be reduced or substantially eliminated.

About Operation of Printer 10

Control of the printer 10 by the control portion 46 will be described with reference to FIG. 11. In step S1, a user turns on the electric power supply of the printer 10 to activate the printer 10. Next, in step S2, the control portion 46 moves the carriage 40 in the X axis directions to perform a measurement operation. Concretely, the control portion 46 checks a change in the load on the carriage driving motor 52, that is, a change in the value of current therethrough, which occur as the carriage 40 moves in the X axis directions. Then, the control portion 46 incorporates the change in the value of current through the carriage driving motor 52 as a correction value into a parameter for the driving control of the carriage 40.

Next, in step S3, the control portion 46 checks whether the measurement operation has ended. When the measurement operation has not ended, the control portion 46 returns to step S2 and continues the measurement operation. When the measurement operation has ended, the control portion 46 checks in step S4 whether the first cartridge 56 has been disposed in or fitted to the carriage 40. Concretely, the control portion 46 sends and receives information about the first cartridge 56 to and from the first information holder 66 that is connected to the connection portion 62*a* of the first disposal section 54*a*.

If the control portion 46 cannot perform the sending and receiving of information to and from the first information holder 66, the control portion 46 determines that the first cartridge 56 has not been disposed in or fitted to the carriage 40 and then in step S5 displays an instruction on the display panel 24 of the operation portion 18. As a concrete example, the control portion 46 causes the display panel 24 to display a message saying, "Attach the first cartridge to the carriage." Then, after the user attaches the first cartridge 56 to the carriage 40 and then operates the operation portion 18, the control portion 46 checks again in step S4 whether the first cartridge 56 has been attached to the carriage 40.

If the control portion 46 has successfully performed the sending and receiving of information to and from the first information holder 66, the control portion 46 checks in step S6 whether the second cartridge 58 has been disposed in or fitted to the carriage 40. Concretely, the control portion 46 sends and receives information about the second cartridge 58 to and from the second information holder 76 that is connected to the connection portion 62*b* of the second disposal section 54*b*.

If the control portion 46 cannot perform the sending and receiving of information to and from the second information holder 76, the control portion 46 determines that the second cartridge 58 has not been disposed in or fitted to the carriage 40 and then in step S7 performs instruction display on the display panel 24 of the operation portion 18. As a concrete example, the control portion 46 causes the display panel 24 to display a message saying, "Attach the second cartridge to the carriage." Then, after the user attaches the second cartridge 58 to the carriage 40 and then operates the operation portion 18, the control portion 46 checks again in step S6 whether the second cartridge 58 has been attached to the carriage 40.

If the control portion 46 has successfully performed the sending and receiving of information to and from the second information holder 76, the control portion 46 goes to step S8 in which the carriage 40 is caused to execute the recording operation by using only the black ink contained in the first cartridge 56.

Note that in this exemplary embodiment, the control portion 46 is configured to be unable to execute the recording operation unless the control portion 46 checks the information about the second cartridge 58 which is stored in the second information holder 76. This will be concretely illustrated below. It is assumed that there is provided a third cartridge that has the same configuration as the second cartridge 58 and that contains a plurality of color inks (e.g., magenta, cyan, and yellow) and that the third cartridge is provided with a third information holder that holds information about the third cartridge. It is also assumed that the information held by the third information holder is different from the information held by the second information holder 76.

If the third cartridge is attached to the second disposal section 54*b*, the control portion 46 sends and receives information stored by the third information holder to and from the third information holder. As a result, the control portion 46 is able to recognize that the cartridge attached to the second disposal section 54*b* of the carriage 40 is not the second cartridge 58. Therefore, the control portion 46 performs such a control as to avoid executing the recording operation of the carriage 40.

Furthermore, this exemplary embodiment adopts a configuration in which the recording operation is executed in a state in which the first cartridge 56 and the second cartridge 58 have been attached to the carriage 40. Therefore, with regard to the effect of ink mist due to the carriage 40 operating within the printer 10, the carriage 40 can be operated in a state in which the first cartridge 56 (black ink) and the third cartridge (color inks) have been attached to the carriage 40, that is, the same state as a carriage used in an existing color ink printer. Hence, the printer 10 can utilize an existing configuration, allowing a cost reduction.

Modifications of First Exemplary Embodiment (1) Although in this exemplary embodiment, the control portion 46 executes the recording operation of the carriage 40 only during the state in which the second cartridge 58 has been attached to the second disposal section 54*b*, the control portion 46 may be configured to execute the recording operation of the carriage 40 also during the state in which the third cartridge has been attached to the second disposal section 54*b*.

(2) Furthermore, although in the exemplary embodiment, the information held by the second information holder 76 and the information held by the third information holder are different from each other, this configuration may be replaced by a configuration in which the information held by the second information holder 76 and the information held by the third information holder are the same.

(3) Furthermore, although in the exemplary embodiment, the second cartridge 58 is detachably attachable to the second disposal section 54*b*, this configuration may be replaced by a configuration in which the second cartridge 58 is fixed to the second disposal section 54*b*.

(4) Further, although in the exemplary embodiment, the second cartridge 58 is an existing color ink cartridge, the second cartridge 58 may instead be configured as a cartridge dedicated to recording in black ink.

(5) Further, although in the exemplary embodiment, the first cartridge 56 and the second cartridge 58 are separate cartridges, the first cartridge 56 and the second cartridge 58 may instead be configured as a single cartridge.

(6) Further, although in the exemplary embodiment, the recording head 42 is provided with no ink discharge nozzles but the ink discharge nozzle for black ink, this configuration may be replaced by a configuration in which an existing recording head provided with ink discharge nozzles that correspond to color inks is directly used.

(7) Although in the exemplary embodiment, whether the first cartridge 56 and the second cartridge 58 have been attached to the carriage 40 is checked after the measurement operation is performed, whether the first cartridge 56 and the second cartridge 58 have been attached to the carriage 40 may instead be checked before the measurement operation.

(8) Further, although in the exemplary embodiment, the first cartridge 56 that contains black ink is attached to the carriage 40, this configuration may be replaced by a configuration in which an ink container portion that contains ink is provided inside or outside the printer 10 and an adapter connected to an ink tube extending from the ink container portion is attached to the carriage 40.

(9) Although in the exemplary embodiment, the second cartridge 58 is disposed at the home position side, the first cartridge 56 may instead be disposed at the home position side.

(10) Further, although in the exemplary embodiment, the control portion 46 executes the measurement operation in the printer 10, the control portion 46 may instead perform such a control as to execute the recording operation without executing the measurement operation in the printer 10.

Second Exemplary Embodiment

Next, a printer 82 according to a second exemplary embodiment will be described with reference to FIG. 12. The second exemplary embodiment is different from the first exemplary embodiment in that the second cartridge 58 in the second exemplary embodiment is not provided with a second information holder 76. Note that in FIG. 12, a cartridge indicated by reference character 84 is a second cartridge in the second exemplary embodiment.

A carriage driver 53 in this exemplary embodiment will be described. The carriage driver 53 includes a driving pulley 86 attached to a driving shaft of a carriage driving motor 52, a driven pulley 88 disposed at a distance from the driving pulley 86 in the X axis directions, and an endless belt 55 wrapped around a driving pulley 86 and a driven pulley 88. A portion of the endless belt 55 is gripped by a portion of the carriage 40. That is, in this exemplary embodiment, too, the carriage 40 is moved back and forth in the X axis directions in FIG. 12 by the carriage driver 53.

A casing 54 of the carriage 40 is provided with a first disposal section 54*a* and a second disposal section 54*b*. A first cartridge 56 that contains a black ink is attached to the first disposal section 54*a*. The first cartridge 56 is provided with a first information holder 66 as an "information holder" that holds information about the first cartridge 56. When the first cartridge 56 is attached to the first disposal section 54*a*, the first information holder 66 is electrically connected to a control portion 46 and sends and receives information about the first cartridge 56 to and from the control portion 46.

A second cartridge 84 is attached to the second disposal section 54*b*. The second cartridge 84 in this exemplary embodiment has substantially the same configuration as the second cartridge 58 in the first exemplary embodiment, except that the second cartridge 84 is not provided with a second information holder 76.

In the second exemplary embodiment, the control portion 46 controls the carriage driving motor 52 via a current measurement portion 90 provided as a "detector". In this exemplary embodiment, the current measurement portion 90 measures the load resistance on the carriage driving motor 52, that is, the value of current through the carriage driving motor 52, during the driving of the carriage driving motor 52.

Next, control of the printer 82 by the control portion 46 will be described with reference to FIG. 13. In step S1, a user turns on an electric power supply of the printer 82 to activate the printer 82. Subsequently, in step S2, the control portion 46 checks whether the first cartridge 56 has been attached to the first disposal section 54*a* of the carriage 40. Concretely, the control portion 46 sends and receives information about the first cartridge 56 to and from the first information holder 66 of the first cartridge 56.

If the control portion 46 cannot perform the sending and receiving of information to and from the first information holder 66, the control portion 46 determines that the first cartridge 56 has not been disposed in or fitted to the carriage 40 and then in step S3 displays an instruction on the display panel 24 of the operation portion 18. As a concrete example, the control portion 46 causes the display panel 24 to display a message saying, "Attach the first cartridge to the carriage." After the user attaches the first cartridge 56 to the carriage 40 and then operates the operation portion 18, the control portion 46 goes back to step S2 and checks again whether the first cartridge 56 has been attached to the carriage 40.

If the control portion 46 has successfully performed the sending and receiving of information to and from the first information holder 66, the control portion 46 performs in step S4 a measurement operation by moving the carriage 40 in the X axis directions. Then, in step S5, the control portion 46 measures a change in the load on the carriage driving motor 52 occurring due to the movement of the carriage 40 in the X axis directions, that is, a change in the value of current, by using the current measurement portion 90.

Then, in step S6, the control portion 46 compares the value of current through the carriage driving motor 52 measured by the current measurement portion 90 with at least one of an initially set value of current through the carriage driving motor 52 which is stored in the control portion 46 or a previously measured value of current through the carriage driving motor 52.

If as a result of the comparison of the thus-measured value of current through the carriage driving motor 52 with at least one of the initially set value and the previously measured value of current through the carriage driving motor 52, it is found that the presently measured value of current is not within a permissible range set for the value of current compared, then the control portion 46 determines that the second cartridge 84 has not been attached to the carriage 40 and, in step S7, displays an instruction on the display panel 24 of the operation portion 18.

As a concrete example, the control portion 46 causes the display panel 24 to display a message saying, "Attach the second cartridge to the carriage." After the user attaches the second cartridge 84 to the carriage 40 and then operates the operation portion 18, the control portion 46 goes back to step S4 again to continue the measurement operation of the carriage 40.

If the value of current presently measured by the current measurement portion 90 is within the permissible range set for the value of current compared, the control portion 46 determines that the second cartridge 84 has been attached to the carriage 40. At this time, the control portion 46 incorporates a change in the value of current through the carriage driving motor 52 as a correction value into a parameter for the driving control of the carriage 40.

Then, in step S8, the control portion 46 executes the recording operation in the printer 82. Concretely, the control portion 46 causes the carriage 40 to operate so as to execute recording on the sheet P by using no inks but the black one contained in the first cartridge 56, with the second cartridge 84 attached to the carriage 40.

Modifications of Exemplary Embodiments (1) Although in the second exemplary embodiment, the current measurement portion 90 that measures the value of current through the carriage driving motor 52 is provided as a detector that detects whether the second cartridge 84 has been attached to the carriage 40, this configuration may be replaced by a configuration in which the second disposal section 54*b* of the carriage 40 is provided with a switch. As a concrete example, there may be provided a configuration in which the aforementioned switch turns on when the second cartridge 84 is attached to the second disposal section 54*b* and the switch turns off when the second cartridge 84 is detached from the second disposal section 54*b*. The switch may operate in the opposite manner. The switch may be a mechanical switch, an optical switch, an electric contact switch, a magnetic switch, etc. as long as the switch is able to detect the attachment and detachment of the second cartridge 84 with respect to the carriage 40.

(2) Although in the exemplary embodiment, the detection of the first cartridge 56 in the carriage 40 is performed prior to the detection of the second cartridge 84, it is also permissible to perform the detection of the first cartridge 56 after the detection of the second cartridge 84.

(3) Furthermore, although in the exemplary embodiment, the second cartridge 84 is attached to the carriage 40, this configuration may be replaced by a configuration in which a balancer (weight piece) is attached to the carriage 40. In this configuration, the weight (mass) of the balancer corresponds to the weight of the second cartridge 84.

To recapitulate the foregoing description, the printer 10 includes the recording head 42 that performs recording on the sheet P and further includes the carriage 40 movable in the apparatus width directions and the control portion 46 that controls the recording head 42 and the carriage 40. The carriage 40 includes the first disposal section 54*a* in which the first cartridge 56 that supplies an ink to the recording head 42 is disposed and the second disposal section 54*b* in which the second cartridge 58 that does not supply ink to the recording head 42. The first cartridge 56 includes the first information holder 66 that holds information about the first cartridge 56 and the second cartridge 58 includes the second information holder 76 that holds information about the second cartridge 58. The control portion 46 executes the control of performing recording by using no inks but the one contained in the first cartridge 56 on the basis of the information held by the second information holder 76.

According to the foregoing configuration, the control portion 46 is able to recognize the state in which the second cartridge 58 in disposed in the second disposal section 54*b*, via the second information holder 76. On the basis of this determination or recognition, the control portion 46 performs the recording operation by using only the ink contained in the first cartridge 56. That is, the recording operation is performed, with the carriage 40 being in a balanced state, so that decline in recording quality can be restrained.

The printer 82 includes the recording head 42 that performs recording on the sheet P and further includes the carriage 40 movable in the apparatus width directions and the control portion 46 that controls the recording head 42 and the carriage 40. The carriage 40 includes the first disposal section 54*a* in which the first cartridge 56 that supplies an ink to the recording head 42 is disposed and the second disposal section 54*b* in which the second cartridge 84 that does not supply ink to the recording head 42 is disposed. The first cartridge 56 includes the information holder 66 that holds information about the first cartridge 56. The control portion 46 executes the control of performing recording by using no inks but the one contained in the first cartridge 56, with the second cartridge 84 disposed in the second disposal section 54*b*, on the basis of information from the current measurement portion 90 that detects that the second cartridge 84 has been disposed in the second disposal section 54*b*.

According to the foregoing configuration, during the state of the carriage 40 in which the first disposal section 54*a* of the carriage 40 has received the first cartridge 56 and the second disposal section 54*b* of the carriage 40 has received the second cartridge 84, the control portion 46 executes the control of performing recording by using no inks but the one contained in the first cartridge 56. That is, the recording operation is performed, with the carriage 40 being in a balanced state, so that reduction in recording quality can be restrained.

Furthermore, in the printers 10 and 82, the recording head 42 includes no liquid discharge nozzles but the one that discharges the ink supplied from the first cartridge 56. According to this configuration, the configuration of the recording head 42 can be simplified and costs can be reduced.

Furthermore, in each of the printers 10 and 82, the region that the second cartridge 58, 84 occupies in the carriage 40 is larger than the region that the first cartridge 56 occupies in the carriage 40. If the carriage 40 were operated in a state in which the second cartridge 58, 84 has been removed, the carriage 40 would become ill balanced. However, in the foregoing configuration, the recording operation is executed in the state of the carriage 40 in which the second cartridge 58, 84 has been disposed, that is, in a balanced state of the carriage 40.

Furthermore, in each of the printers 10 and 82, the second cartridge 58, 84 does not contain ink. According to this configuration, the second cartridge 58, 84 with no ink contained is disposed in the second disposal section 54*b*, so that leakage of ink from the second cartridge 58, 84 in the printer 10, 82 does not occur.

Furthermore, in each of the printers 10 and 82, the upper surface of the second cartridge 58, 84 is provided with the atmospherically open holes 68B, 68C and 68D that provide communication between the inside and the outside of the second cartridge 58, 84.

When the ink contained in the first cartridge 56 is supplied to the recording head 42, it sometimes happens that moisture from the ink in the recording head 42 permeates to the second cartridge 58, 84 and the pressure in the second cartridge 58, 84 increases. However, according to the foregoing configuration, when the pressure in the second cartridge 58, 84 increases, gas inside the second cartridge 58, 84 is let out of the second cartridge 58, 84 through the atmospherically open holes 68B, 68C, 68D and therefore the pressure in the second cartridge 58, 84 decreases. Therefore, the possibility of the pressure in the second cartridge 58, 84 becoming excessively high and damaging a portion of the recording head 42 can be reduced.

Furthermore, in the printers 10 and 82, the liquid supplied from the first cartridge 56 to the recording head 42 is black ink. According to this configuration, it is possible to easily use the printers 10 and 82 as monochrome recording-dedicated machines by using the existing configurations of the printers 10 and 82.

Furthermore, in the printer 10, the second cartridge 58 is detachably attachable with respect to the second disposal section 54*b* and the third cartridge containing inks is also attachable to the second disposal section 54*b*. According to this configuration, since the second disposal section 54*b* is capable of receiving not only the second cartridge 58 but also the third cartridge that contains inks, the carriage 40 can have the same configuration as carriages used in printers in which a first cartridge 56 and a third cartridge both containing ink are fitted to a carriage 40 to perform recording, so that costs can be reduced.

Furthermore, in the printer 10, the third cartridge is provided with the third information holder that holds information about the third cartridge and the information held by the third information holder is different from the information held by the second information holder 76.

Further, in the printer 10, the control portion 46 performs such a control as to avoid operating the carriage 40 on the basis of the information held by the third information holder during the state in which the third cartridge has been disposed in the second disposal section 54*b*.

According to this configuration, while the third cartridge is disposed in the second disposal section 54*b*, the control portion 46 performs such a control as to avoid operating the carriage 40. That is, the control portion 46 does not operate the carriage 40 unless the second cartridge 58 has been disposed in the second disposal section 54*b*. Therefore, operation of the printer 10 with a wrongly disposed cartridge can be prevented.

Further, although in each of the foregoing exemplary embodiments, the second cartridge 58, 84 according to the invention is applied to an ink jet printer as an example of a recording apparatus, the second cartridges 58 and 84 are able to be applied to other liquid ejecting apparatuses in general.

Note that the liquid ejecting apparatuses include not only recording apparatuses, such as printers, copying machines and facsimiles, that employ an ink jet recording head and that discharge ink from the recording head to perform recording on a recording target medium, but also apparatuses that each eject not ink but a liquid provided for a certain use from a liquid ejecting head that corresponds to the ink jet recording head to an ejection target medium that corresponds to the recording target medium, so that the liquid adheres to the ejection target medium.

Examples of the liquid ejecting head include recording heads as mentioned above and further include color material ejecting heads for use in producing color filters of liquid crystal displays and the like, electrode material (electroconductive paste) ejecting heads for use in forming electrodes of organic electroluminescence (EL) displays, field emission displays (FEDs), etc., bioorganic material ejecting heads for use in biochip production, sample ejecting heads as precision pipettes, etc.

Incidentally, the invention is not limited to the foregoing exemplary embodiments. On the contrary, it should be apparent that various modifications and changes can be made within the scope of the invention described in the appended claims and such modifications and changes are encompassed within the scope of the invention.

The entire disclosure of Japanese Patent Application No. 2015-170167, filed Aug. 31, 2015 is expressly incorporated by reference herein.

What is claimed is:

1. A recording apparatus comprising:

a carriage which includes a recording head that performs recording on a medium and which is movable in a first direction and a second direction opposite to the first direction; and a control portion that controls the recording head and the carriage, wherein the carriage includes a first disposal section in which a first cartridge that supplies a liquid to the recording head is disposed and a second disposal section in which a second dummy cartridge that contains no liquid such that the second cartridge does not supply a liquid to the recording head is disposed, the first cartridge having associated therewith a first ink flow path, and the second cartridge having associated therewith at least one other ink flow path even though the second cartridge does not supply the liquid to the recording head, and wherein the first cartridge includes a first information holder that holds information about the first cartridge, and wherein the second cartridge includes a second information holder that holds information about the second cartridge, and wherein the control portion executes a control of performing recording by using no liquids supplied via the carriage but the liquid contained in the first cartridge and supplied via the carriage on the basis of the information held by the second information holder, the recording being performed via the recording head, the recording head including one or more nozzles that are associated only with the first ink flow path such that the recording head lacks any nozzles associated with the at least one other ink flow path of the second cartridge.

2. The recording apparatus according to claim 1, wherein a region that the second cartridge occupies in the carriage is larger than a region that the first cartridge occupies in the carriage.

3. The recording apparatus according to claim 1, wherein an upper surface of the second cartridge has an atmospherically open hole that provides communication between an inside of the second cartridge and an outside of the second cartridge.

4. The recording apparatus according to claim 1, wherein the liquid supplied from the first cartridge to the recording head is a black ink.

5. The recording apparatus according to claim 1, wherein the second cartridge is detachably attachable to the second disposal section, and wherein a third cartridge that contains a liquid is fittable to the second disposal section.

6. The recording apparatus according to claim 5, wherein the third cartridge includes a third information holder that holds information about the third cartridge, and wherein the information held by the second information holder is different from the information held by the third information holder.

7. The recording apparatus according to claim 6, wherein the control portion performs the control so as not to operate the carriage on the basis of the information held by the third information holder while the third cartridge is disposed in the second disposal section.

8. The recording apparatus of claim 1, wherein the first cartridge is disposed at a first side on the carriage, the first side being opposite to a home position side of the carriage, and wherein the second cartridge is disposed at a position nearer the home position than a position of the first cartridge.

9. A recording apparatus comprising:

a carriage which includes a recording head that performs recording on a medium and which is movable in a first direction and a second direction opposite to the first direction; and a control portion that controls the recording head and the carriage, wherein the carriage includes a first disposal section in which a first cartridge that supplies a liquid to the recording head is disposed and a second disposal section in which a second dummy cartridge that contains no liquid such that the second cartridge does not supply a liquid to the recording head is disposed, the first cartridge having associated therewith a first ink flow path, and the second cartridge having associated therewith at least one other ink flow path even though the second cartridge does not supply the liquid to the recording head, and wherein the first cartridge includes an information holder that holds information about the first cartridge, and wherein the control portion executes a control of performing recording by using no liquids supplied via the carriage but the liquid contained in the first cartridge and supplied via the carriage while the second cartridge is disposed in the second disposal section, the recording being performed via the recording head, the recording head including one or more nozzles that are associated only with the first ink flow path such that the recording head lacks any nozzles associated with the at least one other ink flow path of the second cartridge.

10. The recording apparatus according to claim 9, wherein the control portion executes the control of performing recording by using no liquids supplied via the carriage but the liquid contained in the first cartridge and supplied via the carriage, with the second cartridge disposed in the second disposal section, on the basis of information from a detector that detects that the second cartridge has been disposed in the second disposal section.

11. The recording apparatus according to claim 9, wherein the recording head includes no liquid discharge nozzles but a liquid discharge nozzle that discharges the liquid supplied from the first cartridge.

12. The recording apparatus according to claim 9, wherein a region that the second cartridge occupies in the carriage is larger than a region that the first cartridge occupies in the carriage.

13. The recording apparatus according to claim 9, wherein an upper surface of the second cartridge has an atmospherically open hole that provides communication between an inside of the second cartridge and an outside of the second cartridge.

14. The recording apparatus according to claim 9, wherein the liquid supplied from the first cartridge to the recording head is a black ink.

* * * * *